US005690197A

United States Patent [19]

Suganuma et al.

[11] Patent Number: 5,690,197

[45] Date of Patent: Nov. 25, 1997

[54] POWER SUPPLY DEVICE FOR SUPPLYING A DRIVE POWER TO A MOVABLE OBJECT

[75] Inventors: Masanori Suganuma, Kawasaki; Kazuhito Matsuura, Komae; Kohji Okamoto, Zama, all of Japan

[73] Assignee: Konami Co., Ltd., Hyogo-ken, Japan

[21] Appl. No.: 604,519

[22] Filed: Feb. 21, 1996

[30] Foreign Application Priority Data

Feb. 21, 1995 [JP] Japan ..... 7-55229

[51] Int. Cl.[6] ..... B60M 1/00

[52] U.S. Cl. ..... 191/13; 191/6; 191/15

[58] Field of Search ..... 191/6, 13, 14, 191/15, 16, 17, 18, 19, 20, 21

[56] References Cited

U.S. PATENT DOCUMENTS

| | | | |
|---|---|---|---|
| 3,373,524 | 3/1968 | Nirenberg | 191/13 X |
| 3,978,934 | 9/1976 | Schneidinger | 191/13 X |
| 4,336,519 | 6/1982 | Lebecque | 191/18 X |

FOREIGN PATENT DOCUMENTS

| | | | |
|---|---|---|---|
| 2271952 | 12/1995 | France | 191/13 |
| 968836 | 4/1958 | Germany . | |
| 1921755 | 11/1970 | Germany . | |
| 3120648 | 12/1982 | Germany | 191/6 |
| 128703 | 6/1986 | Japan | 191/13 |
| 156287 | 4/1989 | Japan . | |
| 168801 | 7/1990 | Japan | 191/14 |

*Primary Examiner*—Mark T. Le
*Attorney, Agent, or Firm*—Jordan and Hamburg

[57] ABSTRACT

A power supply device includes a power supply member having: a first conductive plate electrically connected with one of positive and negative terminals of a power source; a second conductive plate electrically connected with the other terminal; a first insulating layer provided between the first conductive plate and the second conductive plate; a second insulating layer provided on an outside surface of the second conductive plate; a plurality of supply electrode members attached on an outside surface of the second insulating layer, the plurality of supply electrode members being spaced from one another, one supply electrode member being electrically connected with the first conductive plate, another supply electrode member adjacent to the one supply electrode member being electrically connected with the second conductive plate; a plurality of current collecting electrode members provided in a movable object which is movable on a specified plane, one of at least two current collecting electrode members being operable to come into contact with a supply electrode member connected with the first conductive plate, and the other being operable to come into contact with a supply electrode member connected with the second conductive plate.

14 Claims, 16 Drawing Sheets

POWER SUPPLY DEVICE FOR SUPPLYING A DRIVE POWER TO A MOVABLE OBJECT

BACKGROUND OF THE INVENTION

This invention relates to a power supply device for supplying a drive power to a movable object which is movable over a given surface.

A power supply device of this type is disclosed, for example, in Japanese Unexamined Utility Model Publication No. 1-56287. In the power supply device disclosed in this publication, a plurality of electrode strips are attached on each of a top surface and a bottom surface of an insulating board. The electrode strips on the top surface and the electrode strips on the bottom surface intersect each other. Further, the board is formed with holes through which the upper electrode strips and the lower electrode strips are electrically connected with one another in such a manner that adjacent ones of the electrode strips on each surface have different polarities from each other. The electrode strips on the top surface have the same shape as those on the bottom surface.

In this construction, power supply can be performed on both surfaces of the insulating board. However, it is necessary to form electrodes on each surface. This has made the power supply construction complicated.

SUMMARY OF THE INVENTION

It is an object of the present invention to provide a power supply device which has overcome the problem residing in the prior art.

It is another object of the present invention to provide a power supply device which has a simpler construction.

Accordingly, a power supply device of the present invention comprising: a power supply member which is in the form of a plate and connected with a power source; the power supply member including: a first conductive plate electrically connected with one of positive and negative terminals of the power source; a second conductive plate electrically connected with the other terminal of the power source; a first insulating layer provided between the first conductive plate and the second conductive plate; a second insulating layer provided on the other surface of the second conductive plate that does not face the first insulating layer; a plurality of supply electrode members attached on an outside surface of the second insulating layer, the plurality of supply electrode members being spaced from one another, one supply electrode member being electrically connected with the first conductive plate, another supply electrode member adjacent to the one supply electrode member being electrically connected with the second conductive plate; a plurality of current collecting electrode members provided in a movable object which is movable on a specified plane, one of at least two current collecting electrode members being operable to come into contact with a supply electrode member connected with the first conductive plate, and the other being operable to come into contact with a supply electrode member connected with the second conductive plate.

The plurality of supply electrode members may have the same polygonal shape as one another.

The second conductive plate may be electrically connected with the positive terminal of the power source.

Further, the power supply device may be provided with a third insulating layer provided on the other surface of the first conductive plate that does not face the first insulating layer.

In the power supply device, a plurality of positive supply electrode members are electrically connected with the positive conductive plate. On the other hand, a plurality of negative supply electrode members are electrically connected with the negative conductive plate. In other words, a plurality of supply electrode members are connected with a single conductive plate. Accordingly, the construction is very simple, thus remarkably reducing the time and cost of producing power supply devices.

Also, the supply electrode member is formed into a polygonal shape. Accordingly, a number of supply electrode members can be uniformly arranged over the second insulating layer surface. By setting the size of the supply electrode member in consideration of an arrangement of a plurality of current collecting electrode members provided in a movable object, the likelihood can be eliminated that a plurality of movable objects receive supply voltage from the same supply electrode to undesirably decrease the supply voltage.

The first and second insulating layers are respectively provided on the both surfaces of the positive conductive plate, thereby electrically insulating and protecting the positive conductive plate. Also, the third insulating layer is provided on the outside of the first conductive plate, thereby electrically insulating and protecting the power supply member in entirety.

These and other objects, features and advantages of the present invention will become more apparent upon a reading of the following detailed description and accompanying drawings.

DETAILED DESCRIPTION OF THE PREFERRED EMBODIMENTS OF THE INVENTION

Hereafter, one embodiment of the invention is described in detail with reference to the accompanying drawings.

Figure 1:
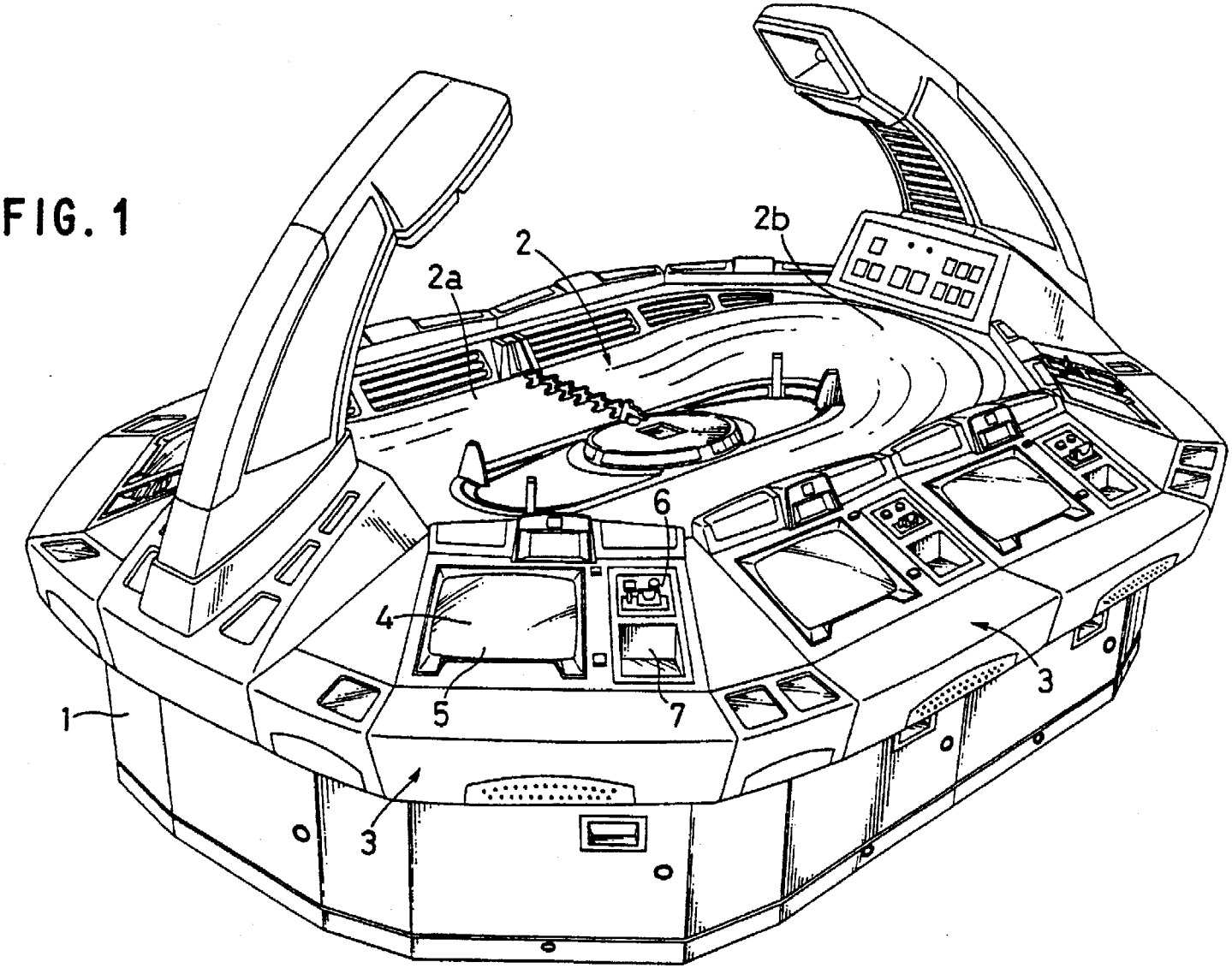
FIG. 1 is a perspective view showing an entire construction of a game machine as one embodiment of the invention.

FIG. 1 is a perspective view showing an entire construction of a game machine as one embodiment of the invention. In this embodiment, the invention is applied to a bicycle race game machine simulating a bicycle race (particularly, so-called "KEIRIN" race). In FIG. 1, indicated at 1 is a base, and by 2 a track formed on the base 1. The track 2 of this embodiment is of oval ring shape in which the opposite ends of two straight tracks 2*a* are connected by round tracks 2*b* of semicircular shape.

The round tracks 2*b* are formed to have a so-called bank shape which slops obliquely upward as it expands from the inner circumference toward the outer circumference. More specifically, the outer circumference of the center portion of the round track 2*b* (a portion farthest from the straight tracks 2*a*) is highest, and the inner circumference of the center portion is at the same height as the straight tracks 2*a*. Connection portion of the round track 2*b* and the straight track 2*a* is also formed such that the outer circumference portion is slightly higher than the inner circumference portion. Such connection portions permit the track 2 to have a continuously curved surface.

Operation units (or control panels) 3 are provided around the base 1. The operation unit 3 is adapted to show specified displays to a player of this game machine and to enable the player to input necessary information. The number of the operation units is equal to the number of players who can play the game at the same time in this machine (6 players in this embodiment).

Each operation unit 3 includes a monitor 4, an operation panel 5 formed of a transparent touch panel provided on the surface of the monitor 4, a coin insertion slot 6 and a coin pay slot 7. On the monitor 4 are displayed information necessary for the game, such as a start of the game, introduction of participating bicycle racers, odds, and prize. The player is allowed to input a variety of information by means of the operation panel 5. For example, the player makes a bet by means of the operation panel 5.

In this embodiment, six model bicycles 80 are placed on the track 2. The respective model bicycles are enabled to run on the track 2 by means of a drive mechanism to be described below.

Figure 2:
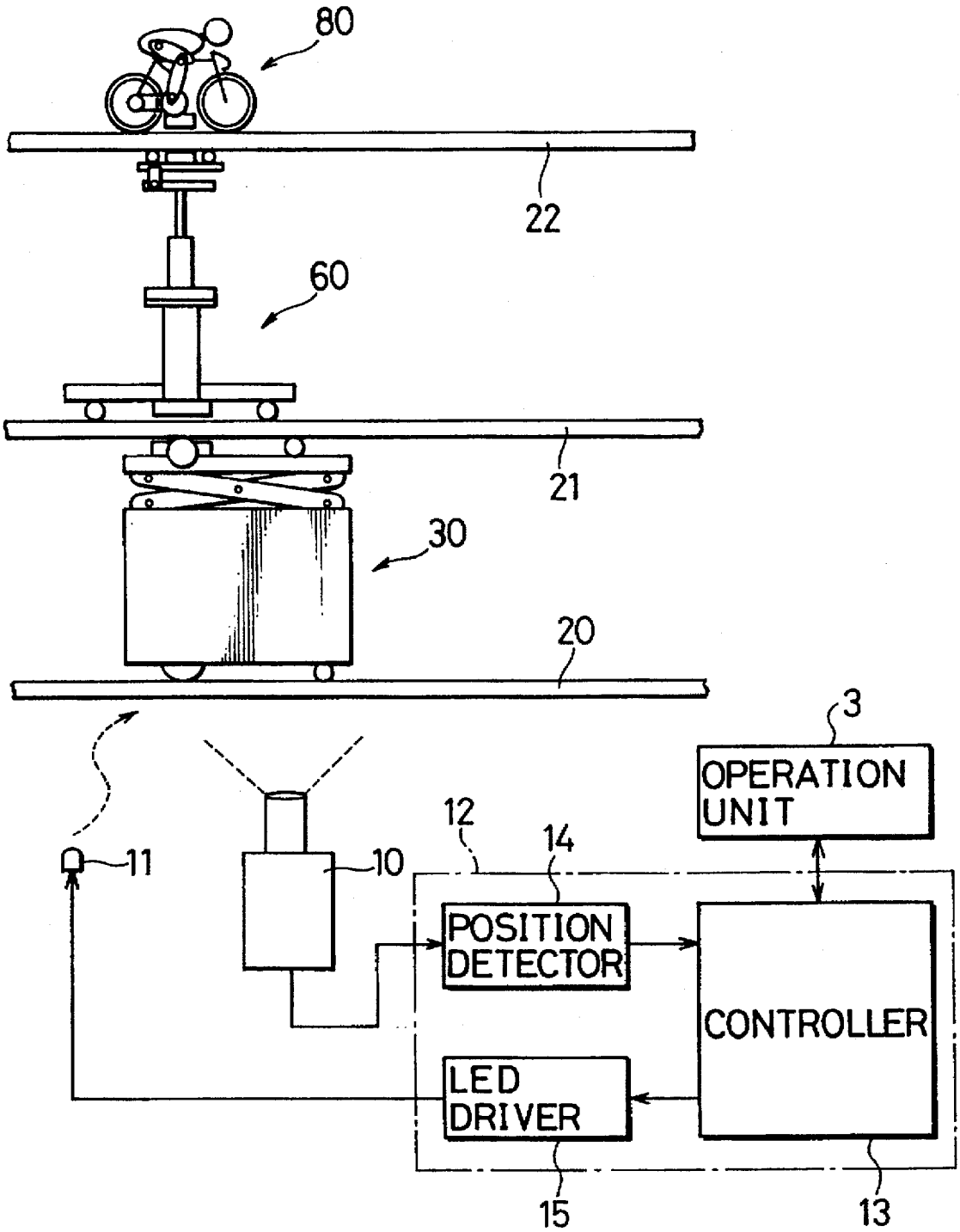
FIG. 2 is a diagram schematically showing a drive mechanism for driving a model bicycle used in this embodiment.

FIG. 2 is a diagram schematically showing the drive mechanism for driving the model bicycle. As shown in FIG. 2, the base 1 of the game machine includes a support plate 20 of glass or like material which permits a light beam to pass therethrough, an intermediate support plate 21 disposed in parallel with and above the support plate 20, and a running plate 22 having an upper surface which forms the track 2. Thus, the base 1 has a three-storied structure. Running bodies 30 and intermediate vehicles 60 are disposed between the support plate 20 and the intermediate support plate 21, and between the intermediate support plate 21 and the running plate 22, respectively. The numbers of the running bodies 30 and the intermediate vehicles 60 are each equal to the number of the model bicycles. The model bicycles 80 are disposed on the upper surface of the running plate 22 (i.e. on the upper surface of the track 2).

Figure 3:
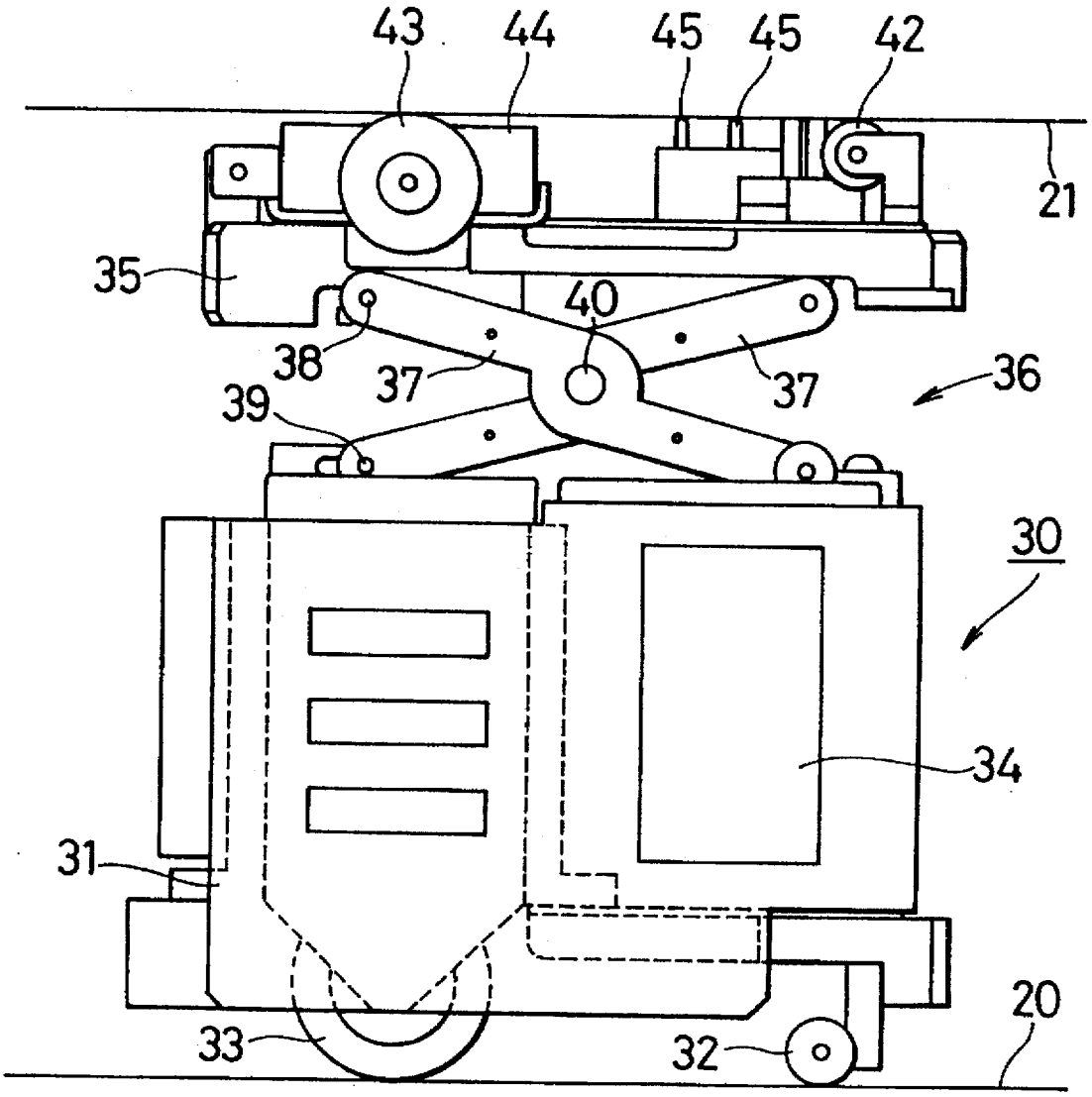
FIGS. 3 and 4 are front and right side views showing an external construction of a running body used in this embodiment, respectively.
Figure 4:
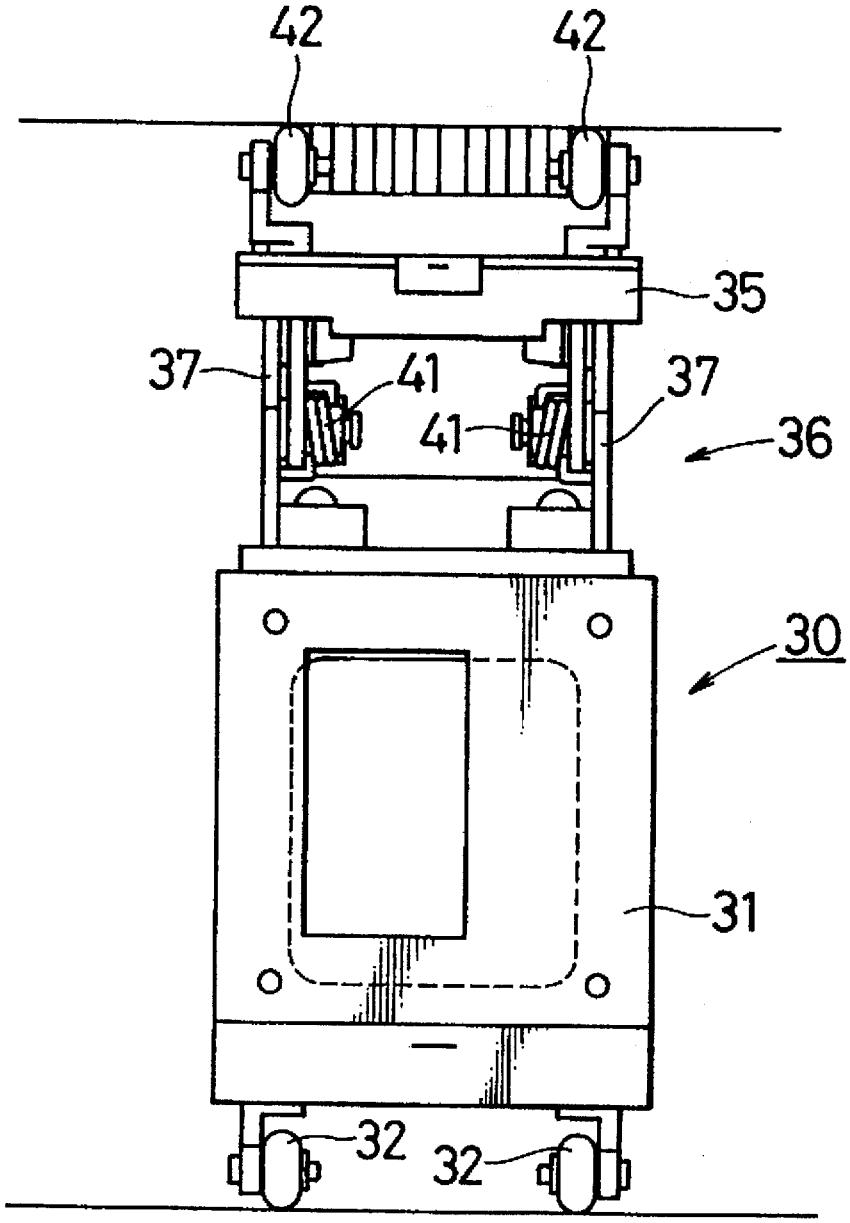

FIGS. 3 and 4 are front and right side views showing the external construction of the running body 30. In these FIGURES, indicated at 31 is a hollow rectangular casing of the running body 30. Casters 32 and drive wheels 33 are rotatably mounted at a front bottom portion of the casing 31 (right side in FIG. 3) and at a rear bottom portion of the casing 31 (left side in FIG. 3) with respect to a moving direction of the casing 31. An unillustrated drive shaft of the drive wheels 33 are coupled with a motor unillustrated in FIGS. 3 and 4, and the drive wheels 33 are driven by this motor. Indicated at 34 is a circuitry board housed in the casing 31. A variety of circuits such as a microcomputer to be described later are formed on the base plate 34.

Indicated at 35 is an upper base located above the casing 31. The casing 31 and the upper base 35 are connected via an extensible pantograph mechanism 36 such that they move with respect to each other in the vertical direction. The pantograph mechanism 36 includes two each of link members 37 provided at the upper left and right ends of the casing 31. The opposite ends of each link member 37 are connected with the upper part of the casing 31 and the lower part of the upper base 35 via pins 39 and 38, respectively. The two link members 37 at the left and right sides are connected in their center via a pin 40, and are biased by a spring 41 in such a direction that a distance between the casing 31 and the upper base 35 becomes larger.

A pair of casters 42 and a pair of rollers 43 are rotatably mounted at a front portion of the upper base 35 and at the left and right sides of the upper base 35 with respect to a moving direction of the upper base 35, respectively. The upper ends of the casters 42 and the rollers 43 are at the same height. As shown in FIG. 2, when the running body 30 is disposed between the support plate 20 and the intermediate support plate 21, the upper ends of the casters 42 and the rollers 43 come into contact with the bottom surface of the intermediate support plate 21 and accordingly rotate as the running body 30 runs. A permanent magnet 44 is disposed between the rollers 43. The upper end of the permanent magnet 44 is set slightly lower than that of the rollers 43. Thus, when the rollers 43 are in contact with the bottom surface of the intermediate support plate 21, the permanent magnet 44 is spaced apart from this bottom surface by a very small distance.

Indicated at 45 are current collecting electrode members disposed at the front portion of the upper base 35 with respect to its moving direction. The current collecting electrode member 45 is described in detail with reference to FIGS. 13 and 14.

Figure 13:
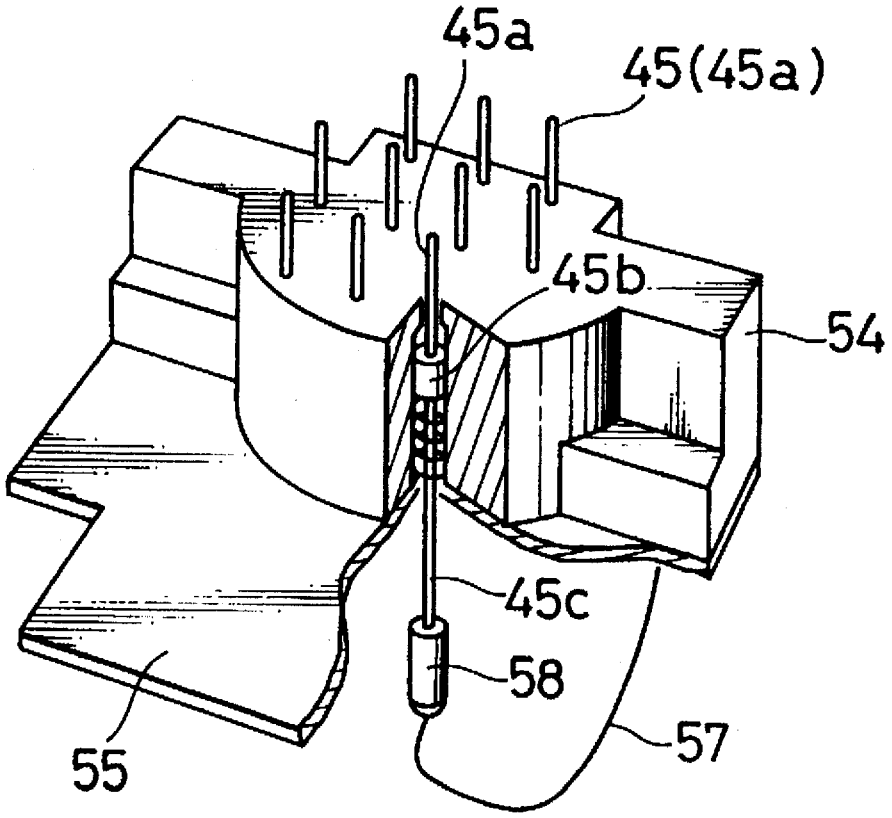
FIGS. 13 and 14 are a partially cut-away perspective view and a cross sectional view showing current collecting electrode members in this embodiment.
Figure 14:
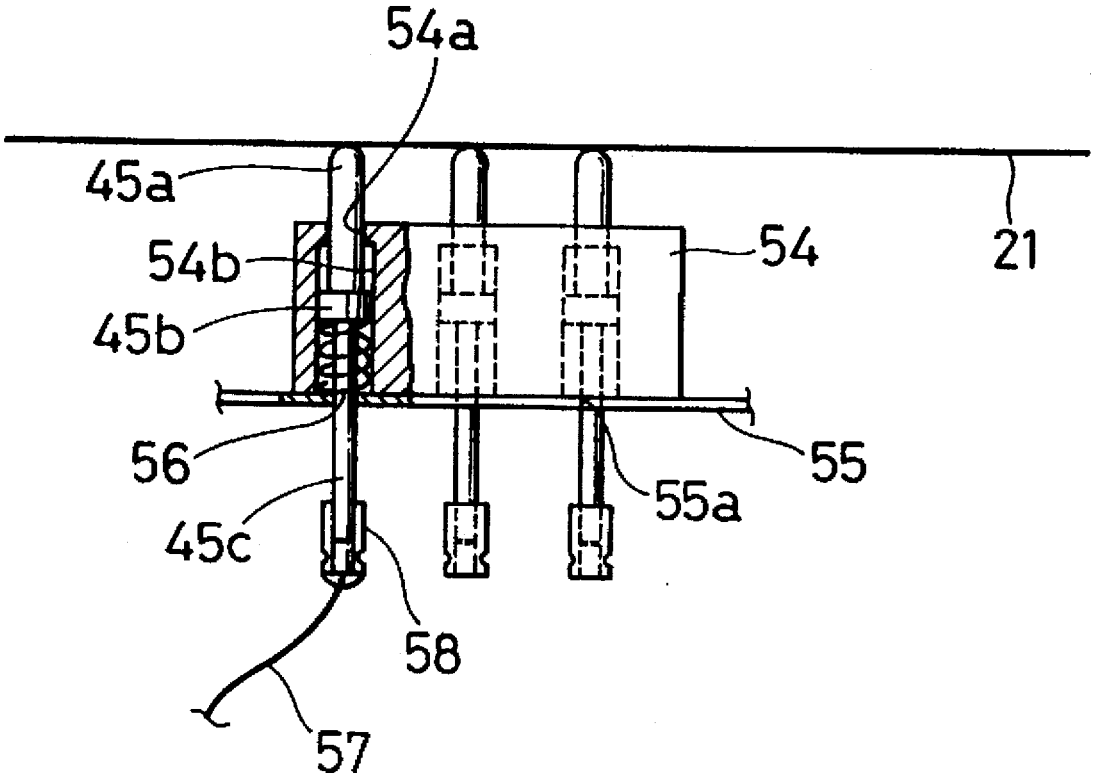

FIGS. 13 and 14 are a partially cut-away perspective view and a cross sectional view showing a supporting construction of the current collecting electrode members 45. In these drawings, a plurality of current collecting electrode members 45 are implanted in an electrode support block member 54 attached to a base plate 55. The current collecting electrode member 45 includes a contact portion 45*a* having an upper end formed into a hemispherical shape, a stopper portion 45*b* below the contact portion 45*a* having a diameter larger than that of the contact portion 45*a*, and a ground portion 45*c* below the stopper portion 45*b* having a diameter smaller than that of the stopper portion 45*b*.

The electrode support block member 54 is formed with through holes 54*a* and accommodation holes 54*b*. The through hole 54*a* has a diameter slightly larger than that of the contact portion 45*a* and smaller than that of the stopper portion 45*b*. The accommodation hole 54*b* is formed below and communicated with the through hole 54*a*. The accommodation hole 54*b* has a diameter slightly larger than that of the stopper portion 45*b*. The base plate 55 is formed with through holes 55*a* at positions corresponding to the accommodation holes 54*b*. The through hole 55*a* has a diameter slightly larger than that of the ground portion 45*c* and smaller than that of the stopper portion 45*b*.

In this way, the current collecting electrode members 45 are supported in the electrode support block member 54 movably upward and downward at a stroke of the vertical length of the accommodation hole 54*b*. A spring 56 is arranged between the stopper portion 45*b* and the base plate 55 in a state that it is accommodated in the accommodation hole 54*b*. The current collecting electrode members 45 are constantly biased upward by the biasing force of the springs 56.

Indicated at 57 is a lead wire whose one end is connected to a stabilized power source (see FIG. 5) and whose other end is connected to the ground portion 45*c* of the current collecting electrode member 45 via a base member 58 for wiring.

On the other hand, on the bottom surface of the intermediate support plate 21 are arranged positive and negative supply electrodes for supplying power. A supply voltage is supplied to the respective electrodes from an external power source.

Figure 15:
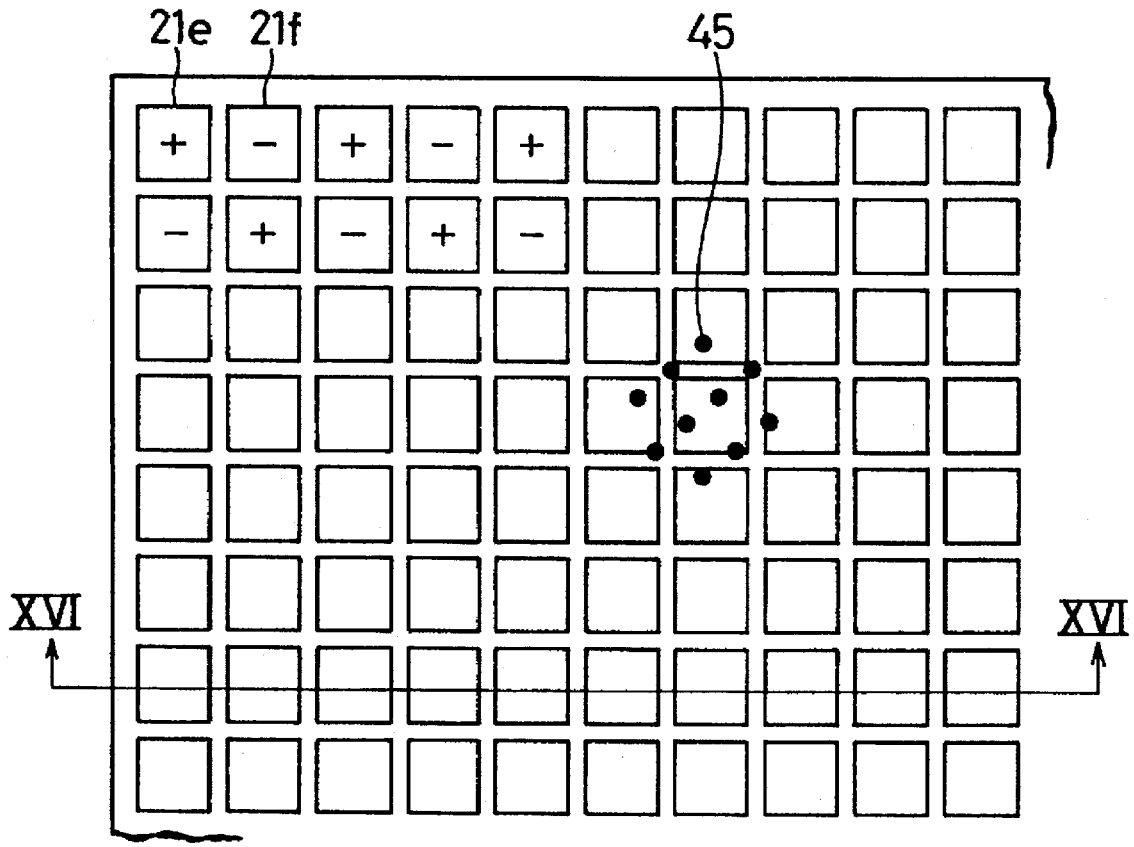
FIG. 15 is a bottom plan view showing a bottom surface of an intermediate support plate.
Figure 16:
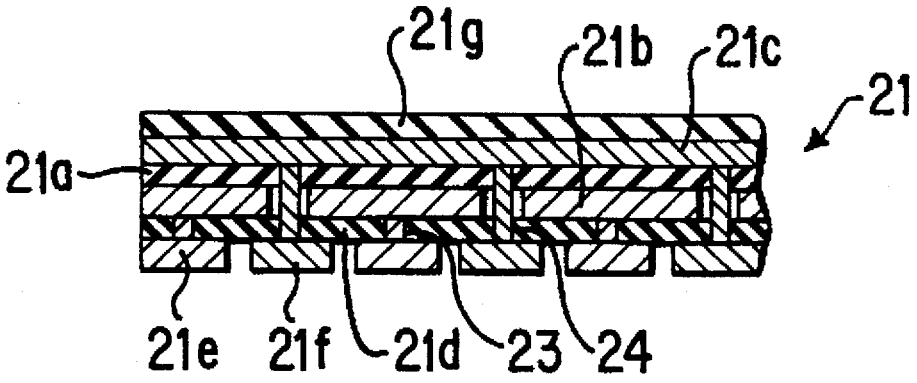
FIG. 16 is a cross sectional view taken along the line XVI—XVI in FIG. 15.

FIG. 15 is a bottom plan view showing the arrangement of supply electrodes on the bottom surface of the intermediate support plate 21. FIG. 16 is a cross sectional view taken along the line XVI—XVI in FIG. 15.

In these drawings, the intermediate support plate 21 includes a single positive conductive plate 21*b* and a single negative conductive plate 21*c*. Between the positive and negative conductive plates 21*b* and 21*c* is provided a first insulating layer 21*a*. Also, a second insulating layer 21*d* is provided on a bottom surface of the positive conductive plate 21*b*. Further, a third insulating layer 21*g* is provided on a top surface of the negative conductive plate 21*c*.

On a bottom surface of the second insulating layer 21*d* are arranged positive and negative supply electrode members 21*e* and 21*f*. The positive and negative supply electrode members 21*e* and 21*f* have an identical square shape and are arranged in a checkerboard-like formation at a specified interval from one another. The positive supply electrode members 21*e* are electrically connected with the positive conductive plate 21*b* via connectors 23 passing through the second insulating layer 21*d*. Similarly, the negative supply electrode members 21*f* are electrically connected with the negative conductive plate 21*c* via connectors 24 passing through the second insulating layer 21*d*, the positive conductive plate 21*b*, and the first insulating layer 21*a*. The connector 24 is kept from coming into contact with the positive conductive plate 21*b*. The positive supply voltage is supplied from the unillustrated external power source to the positive conductive plate 21*b*. The negative conductive plate 21*c* is grounded. In this way, adjacent supply electrodes 21*e* and 21*f* have the opposite polarities to one another.

In this construction, the respective upper ends of the contact portions 45*a* of the current collecting electrode members 45 come into contact with positive supply electrode members 21*e* and negative supply electrode members 21*f* of the intermediate support plate 21 by the biasing force of the springs 56 when the running body 30 is placed between the support plate 20 and the intermediate support plate 21. The upper ends of the contact portions 45*a* are always kept in sliding contact with positive and negative supply electrode members 21*e* and 21*f* even when the running body 30 runs on the support plate 20. Accordingly, the supply voltage from the external power source can be reliably supplied to the running body 30 via the current collecting electrode members 45.

Specifically, a pair of diodes in opposite directions are connected with each of the current collecting electrode members 45. Output lines of the forward direction diodes are combined into one line which is connected with a positive terminal of the stabilized power source. Output lines of the reverse direction diodes are combined into one line which is connected with a negative terminal of the stabilized power source. Accordingly, if at least one of the current collecting electrode members 45 comes into contact with a positive supply electrode members 21*e* and at least one of the current collecting electrode members 45 comes into contact with a negative supply electrode member 21*f* of the intermediate support plate 21, the supply voltage from the external power source is supplied to the stabilized power source. The polarity is constantly fixed.

For this reason, the current collecting electrode members 45 are arranged in such a way that at least one current collecting electrode member 45 comes into contact with a positive supply electrode member 21*e* and at least one of the current collecting electrode members 45 comes into contact with a negative supply electrode member 21*f* at any running position of the running body 30 on the support plate 20. As shown in FIG. 15, in this embodiment, the positive supply electrode member 21*e* and negative supply electrode member 21*f* each have a square shape of 8 mm×8 mm and are spaced from one another at an interval of 2.5 mm. On the other hand, in the support block member 54 are provided ten current collecting electrode members 45. The ten current collecting electrode members 45 are arranged in three rows. Specifically, three electrodes are arranged in one side row, four in an intermediate row, and three in the other side row. Adjacent current collecting electrode members 45 in each row are spaced apart at an interval of 5 min. The interval between adjacent rows is 6 mm. The current collecting electrode members 45 in the intermediate row are shifted from the current collecting electrode members 45 in the side rows 2.5 mm.

In other words, all the ten current collecting electrode members 45 form in entirety a hexagon having six apexes and sides. Six current collecting electrode members 45 are arranged at the six apexes, respectively. Two current collecting electrode members 45 are arranged at respective intermediate point of two longer sides. The other two current collecting electrode members 45 are in the hexagon. Accordingly, as shown in FIG. 15, at any position of the running body 30, it can be reliably that at least one of the current collecting electrode members 45 comes into contact with a positive supply electrode member 21*e* and at least one of the current collecting electrode members 45 comes into contact with a negative supply electrode member 21*f*.

Further, the diameter of the contact portion 45*a* of each current collecting electrode member 45 is smaller than the interval between the positive supply electrode member 21*e* and the negative supply electrode member 21*f* which are adjacent to each other (in this embodiment, 1.5 mm).

Accordingly, the likelihood is eliminated that one current collecting electrode member 45 comes into contact with both the positive supply electrode member 21*e* and the negative supply electrode member 21*f*. A stabilized supply voltage can be supplied.

Figure 5:
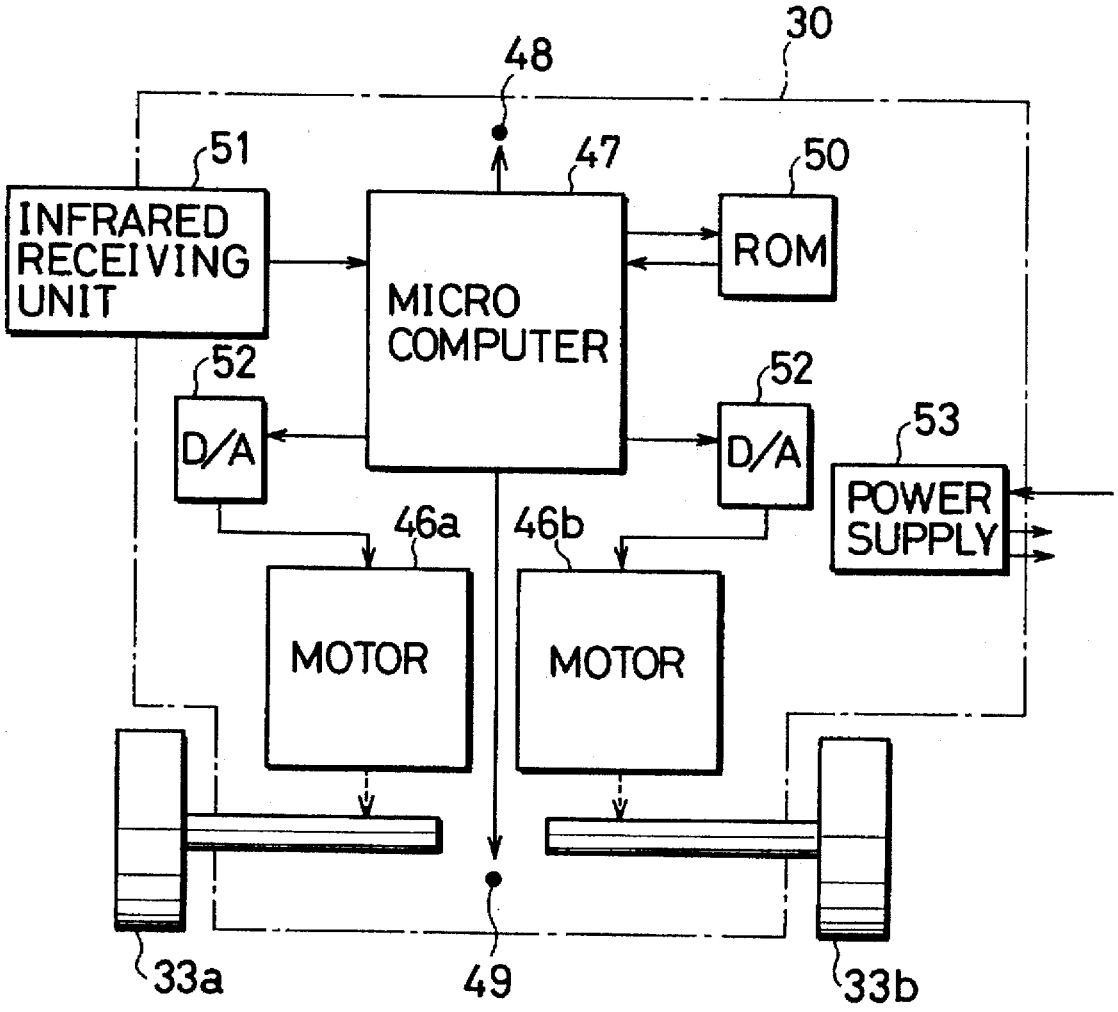
FIG. 5 is a block construction diagram of the running body when viewed from above.

FIG. 5 is a block construction diagram of the running body when viewed from above.

The running body 30 includes a pair of motors 46*a*, 46*b* for independently driving the pair of drive wheels 33*a*, 33*b* of resin or like material. In the description below, the drive wheels 33*a*, 33*b* and the motors 46*a*, 46*b* are indicated at 33, 46 respectively unless specified.

In this embodiment, DC motors are used as the motors 46 so that the speed of the running body 30 can be duty-controlled and the running body 30 can run backward (by inversion of polarity of a supply current) if necessary. Alternatively, pulse motors may be used so as to enable a speed control using a pulse frequency. Reduction gears are provided in a plurality of positions between a rotatable shaft of the motor 46 and that of the drive wheel 33 to ensure a specified speed range.

Indicated at 47 is a one-chip microcomputer as a controller of the running body 30. The microcomputer 47 analyzes a signal transmitted from a transmission LED 11 of a game machine main body 12 to generate a run control signal for the running body 30, and causes front and rear LEDs 48, 49 for emitting infrared rays. A ROM 50 is adapted to store an operation program of the microcomputer 47. Indicated at 52 is a digital-to-analog (D/A) converter for converting a digital signal used for a speed control which is output from the microcomputer 47 into an analog signal used to drive the motors 46.

The front and rear LEDs 48, 49 are disposed at a front center portion and at a rear center portion of the casing 31 (not shown in FIG. 5) of the running body 30 such that they are both directed right downward. A frequency band of the infrared rays emitted when the front and rear LEDs 48, 49 are turned on corresponds with a transmission frequency band of an infrared filter provided on the front surface of a CCD camera 10 to be described later. Only the infrared rays having a frequency within the transmission frequency band can pass through the infrared filter. The infrared rays passed through the infrared filter are sensed by the CCD camera 10 disposed below the support plate 20. The LEDs 48, 49 are fabricated such that the rays propagate over a wide angle. The rays can be sensed by the CCD camera 10 in any arbitrary position on the support plate 20.

Indicated at 51 is an infrared ray receiving unit which includes a photodiode or the like for receiving an optical pulse signal transmitted from the transmission LED 11. The unit 51 is so disposed as to face downward at the center bottom portion of the casing 31 of the running body 30. The unit 51 is, for example, exposed so as to receive the rays over a wide range. Indicated at 53 is a stabilized power supply circuit for generating voltages from the supply voltage supplied from the external power source such as a voltage of 5V necessary to operate the microcomputer 47 and a voltage of 6V necessary to operate the motor.

Figure 6:
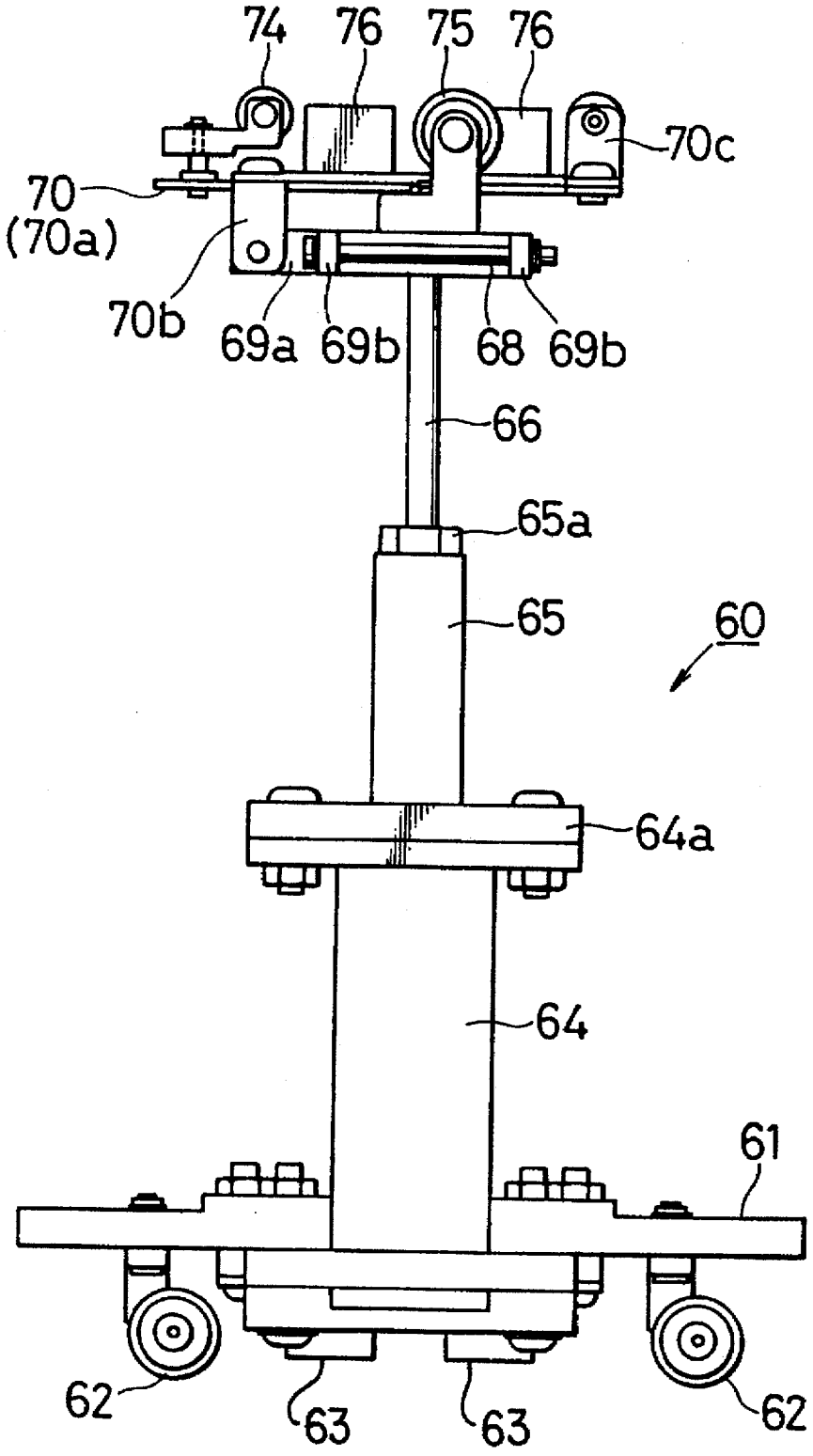
FIGS. 6, 7 and 8 are front, left side and plan views showing the external construction of an intermediate vehicle used in this embodiment, respectively.
Figure 7:
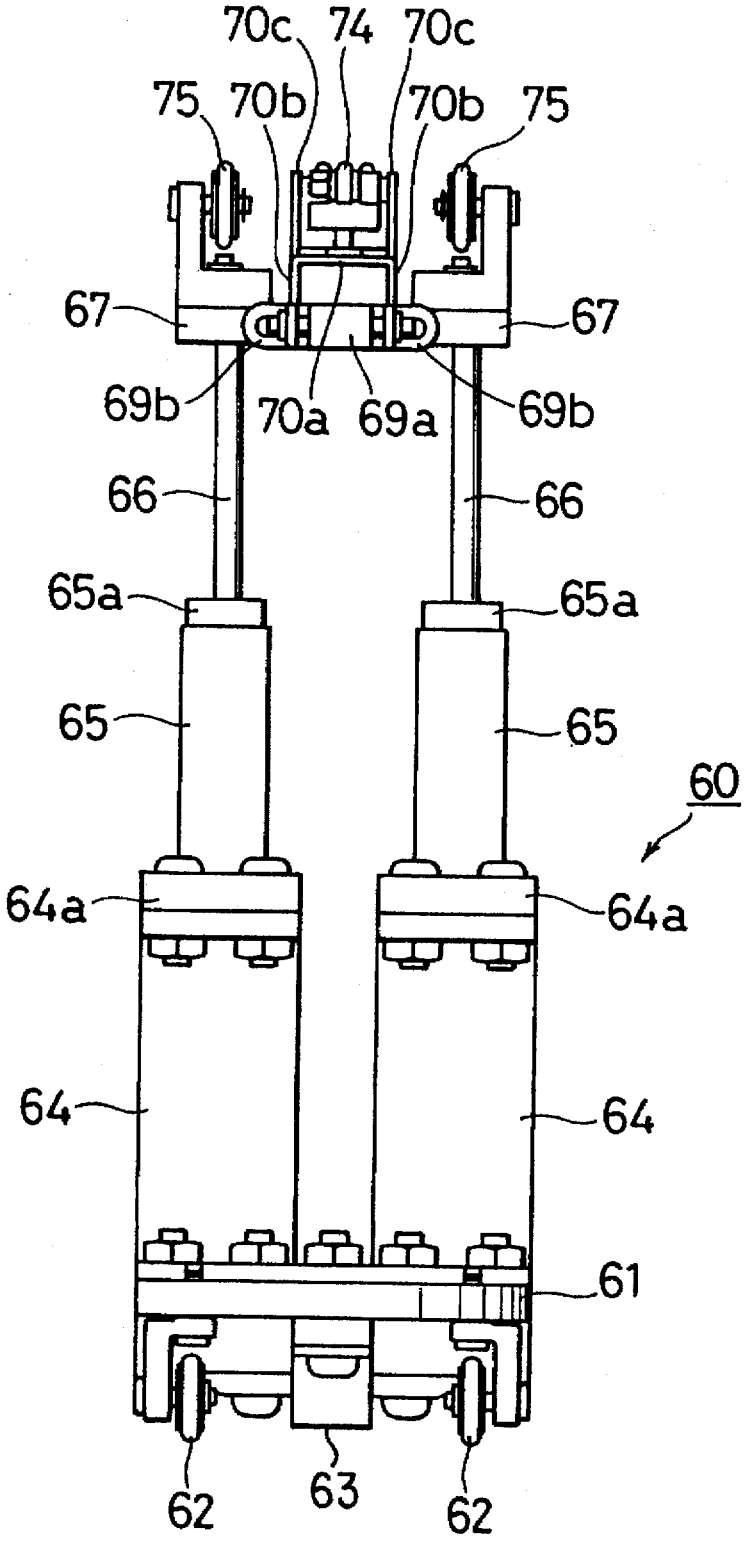
Figure 8:
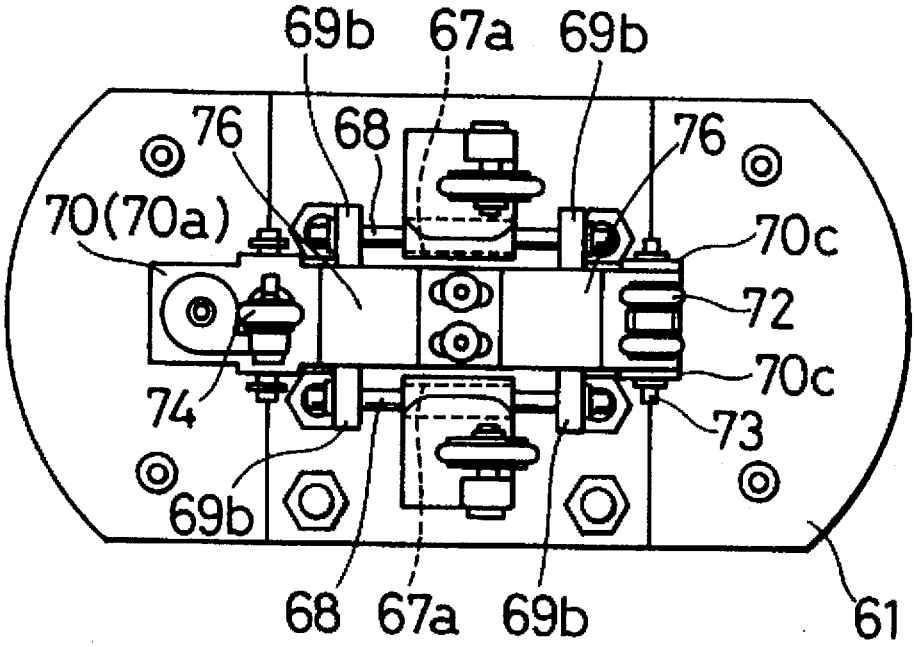

FIGS. 6, 7 and 8 are front, left side and plan views showing the external construction of an intermediate vehicle 60 used in this embodiment, respectively. In these FIGURES, indicated at 61 is a plate-like base. A pair of casters 62 are mounted at the opposite lateral ends of each of the front (right side in FIG. 6) and rear (left side in FIG. 6) portions of the base 61 with respect to a moving direction of the base 61. In other words, four casters 62 are mounted. Indicated at 63 is a permanent magnet mounted on the bottom surface of the base 61. The lower end of the permanent magnet 63 is set slightly higher than the lower ends of the casters 62. Accordingly, when the intermediate vehicle 60 is placed on the intermediate support plate 21, the permanent magnet 63 is located above and spaced apart from the upper surface of the intermediate support plate 21 by a very small distance.

Large cylinders 64 having an open upper end and a closed bottom stand upright at the opposite lateral ends of the base 61. A small cylinder 65 having a diameter smaller than that of the large diameter 64 is accommodated in each large cylinder 64. Similar to the large cylinders 64, the small cylinders 65 each have an open upper end and a closed bottom. An unillustrated spring is disposed between the bottom of the small cylinder 65 and that of the large cylinder 64. A piston rod 66 is accommodated in each small cylinder 65. An unillustrated spring is also disposed between the bottom of the piston rod 66 and that of the small cylinder 65. Accordingly, the small cylinder 65 and the piston rod 66 are constantly biased upward. At the upper end of the large cylinder 64 is mounted a pressing member 64*a* for preventing the small cylinder 65 from coming out of the large cylinder 64, Further, at the upper end of the small cylinder 65 is mounted a nut 65*a* for preventing the piston rod 66 from coming out of the small cylinder 65.

A bracket 67 is secured on the upper end of each piston rod 66. In each bracket 67 is formed a through hole 67*a* which horizontally extends along a moving direction (lateral direction of FIG. 8) of the intermediate vehicle 60 as best shown in FIG. 8. The through holes 67*a* are formed on inner portions of the corresponding brackets 67. A rotatable rod 68 is inserted through each through hole 67*a*. The opposite ends of the rotatable rod 68 are rotatably connected with coupling plates 69. The coupling plate 69 includes a rectangular plate-like main body 69*a* and flanges 69*b* projecting in the lateral directions from the front and rear ends of the main body 69*a*. The flanges 69*b* are each formed with an unillustrated through hole through which the rotatable rods 68 are inserted.

A pivotal member 70 is pivotally mounted at the rear end (left end in FIG. 6) of the coupling plate 69. The pivotal member 70 includes a narrow plate-like base portion 70*a*, a pair of pivotal mount portions 70*b* extending downward from the opposite ends of the rear end (left end in FIG. 6) of the base portion 70*a*, and a pair of plate-like roller mount portions 70*c* extending upward from the opposite ends of the front end (right end in FIG. 6) of the base portion 70*a*.

An unillustrated through hole is formed to horizontally extend at the rear end of the coupling plate 69. A through hole is also formed in the pivotal mount portion 70*b* of the pivotal member 70. By inserting and fixing a pin 71 in the through holes of the coupling plate 69 and the pivotal mount portion 70*b*, the pivotal member 70 is pivotally mounted with respect to the coupling plate 69. An unillustrated spring is disposed between the coupling plate 69 and the pivotal member 70. This spring constantly biases the pivotal member 70 upward.

On the other hand, a through hole is formed in the roller mount portion 70*c* of the pivotal member 70. By inserting a rotatable shaft 73 of a roller 72 through this through hole, the roller 72 is rotatably mounted with respect to the pivotal member 70. Indicated at 74 is a caster mounted at the rear end of the base portion 70*a* of the pivotal member 70. Similarly, a caster 75 is mounted above the bracket 67. The rollers 72 and the casters 74, 75 are set such that their upper ends are at the same height in an extended state of the two smaller cylinders 65 and the two piston rods 66.

Indicated at 76 is a permanent magnet mounted on the upper surface of the base portion 70*a* of the pivotal member 70. The upper end of the permanent magnet 76 is set slightly lower than the upper ends of the rollers 72 and the casters 74, 75. Accordingly, when the intermediate vehicle 60 is disposed between the intermediate support plate 21 and the running plate 22, the permanent magnet 76 is located below and spaced apart from the lower surface of the running plate 22 by a very small distance.

In the above construction, even if the distance between the intermediate support plate 21 and the running plate 22 changes, the small cylinders 65 and the piston rods 66 suitably extend and contract, with the result that the roller 72 and the casters 74, 75 are constantly in contact with the lower surface of the running plate 22 and roll along the lower surface of the running plate 22 as the intermediate vehicle moves. In addition, even if the running plate 22 tilts along the moving direction (lateral direction in FIG. 6) of the intermediate vehicle 60, the pivotal plates 70 pivot with respect to the coupling plates 69 and thereby the rollers 72 and the casters 74 are inclined with respect to the moving direction. As a result, the rollers 72 and the casters 74 constantly remain in contact with the lower surface of the running plate 22.

Further, even if the running plate 22 tilts along a direction (lateral direction in FIG. 7) normal to the moving direction of the intermediate vehicle 60, the pairs of small cylinders 65 and piston rods 66 extend and contract independently of each other, with the result that the casters constantly remain in contact with the lower surface of the running plate 22. Thus, even if the running plate 22 has a three-dimensionally curved surface, the rollers 72 and the casters 74, 75 are constantly in contact with the bottom surface of the running plate 22 as long as the curved surface is continuous, i.e. can follow the height change of the curved surface.

The length and the extension/contraction stroke of the large cylinders 64, the small cylinders 65 and the piston rods 66 are so set as to sufficiently respond to a distance change between the intermediate support plate 21 and the running plate 22. In this embodiment, when the model bicycle 80 to be described later is located on the linear track 2*a* (i.e. when the distance between the intermediate support plate 21 and the running plate 22 are shortest), the small cylinders 65 and the piston rods 66 contract to their positions closer to their most contracted positions. On the other hand, when the model bicycle 80 is located at the outer circumference of the center portion of the round track 2*b* (i.e. when the distance between the intermediate support plate 21 and the running plate 22 is longest), the small cylinders 65 and the piston rods 66 extend to their positions closer to their most extended positions.

FIGS. 9, 10, 11 and 12 are front, left side, right side and plan views showing the external construction of the model bicycle, respectively. In these FIGURES, indicated at 81 is a main frame of the model bicycle 80, by 82 a front wheel, and by 83 a rear wheel. The wheels 82 and 83 are both rotatably mounted on the main frame 81. Indicated at 84 is a drive pulley which is so secured on a rotatable shaft of the rear wheel 83 as to rotate together with the rear wheel 83. Indicated at 85 is a crank pulley which is rotatably mounted on the main frame 81. A drive force of the drive pulley 84 is transmitted to the crank pulley 85 via a rubber belt 86, with the result that, as the rear wheel 83 rotates, the crank pulley 85 rotates in the same direction.

Figure 9:
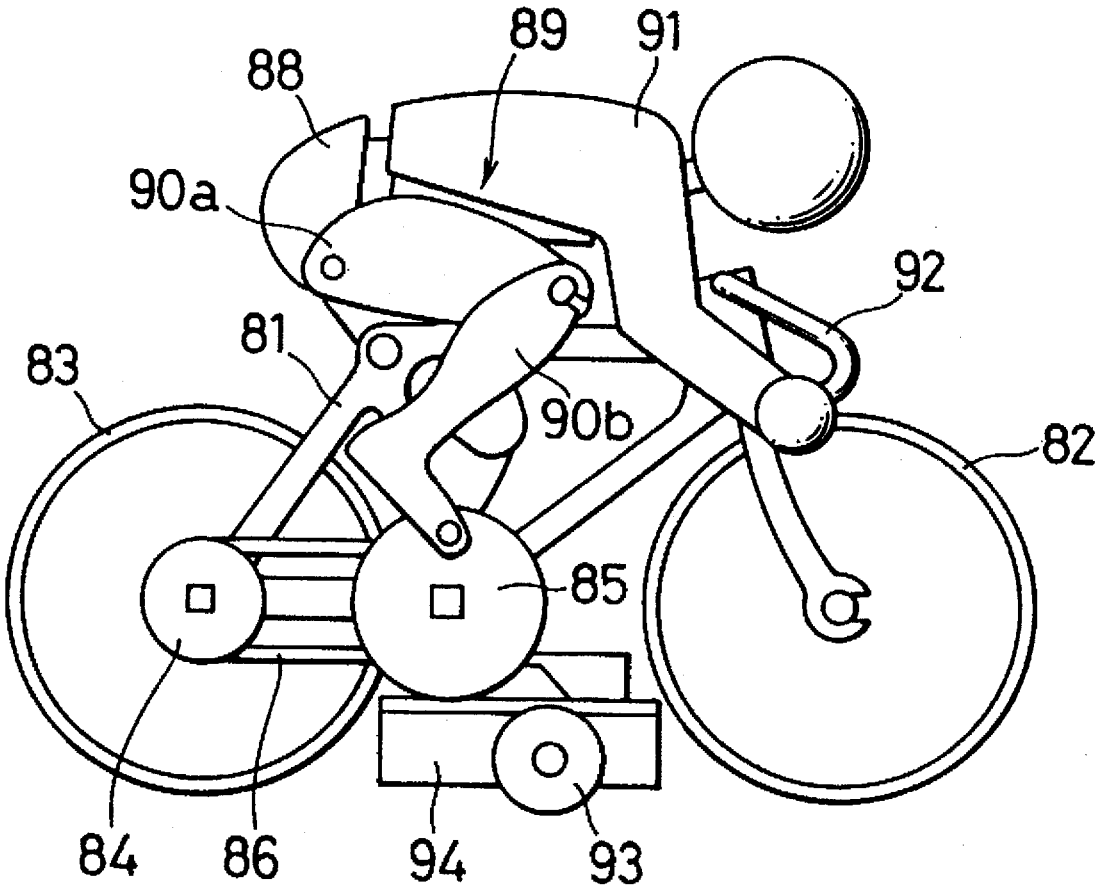
FIGS. 9, 10, 11 and 12 are front, left side, right side and plan views showing the external construction of the model bicycle, respectively.
Figure 10:
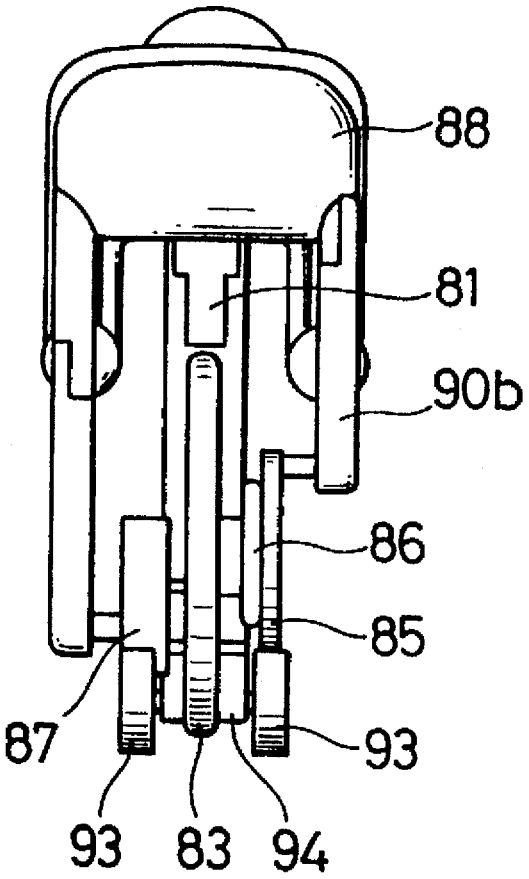
Figure 11:
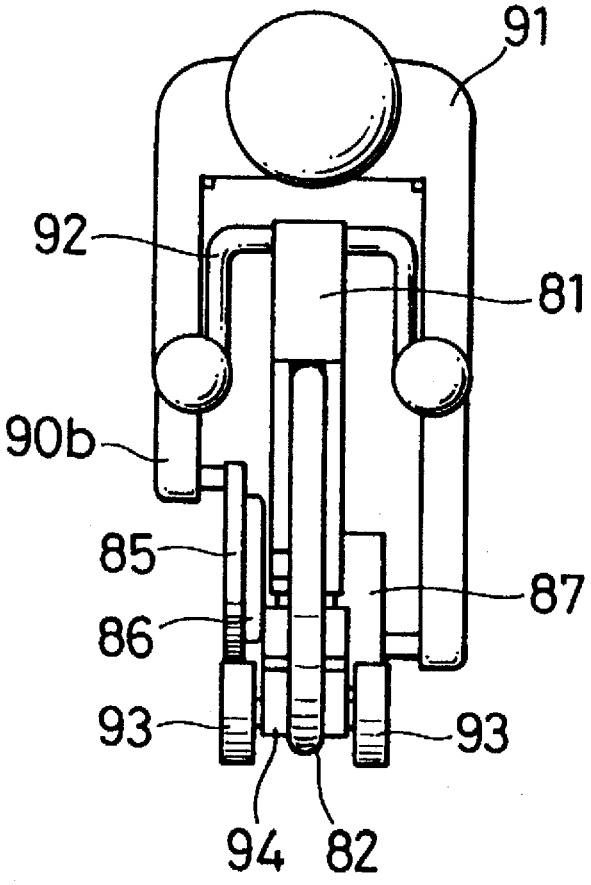
Figure 12:
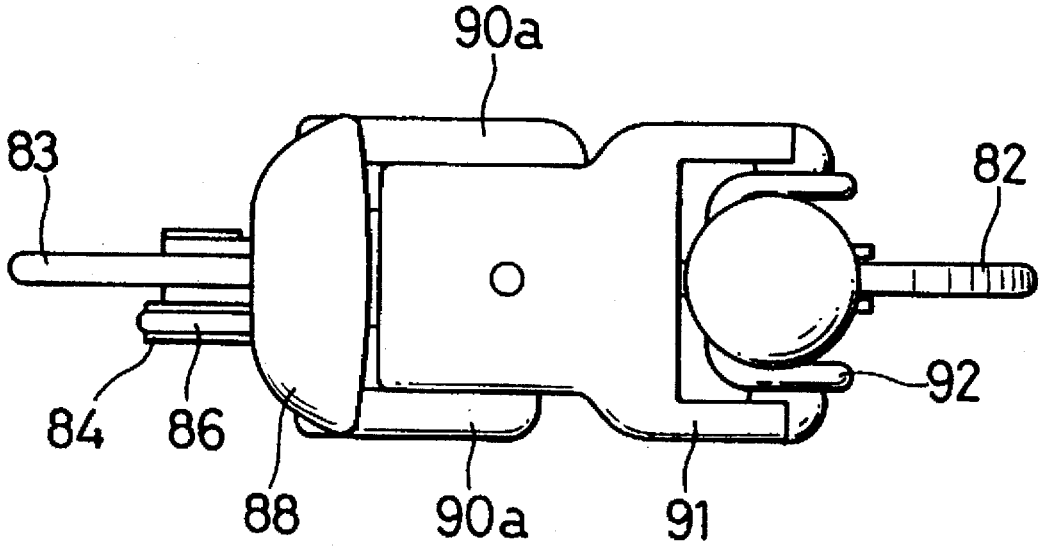

Though unillustrated in FIG. 9, a crank pedal 87 is rotatably mounted on the main frame 81 on the side opposite from the crank pulley 85. Being secured on a rotatable shaft of the crank pulley 85, the crank pedal 87 rotates together with the crank pulley 85.

Indicated at 88 is a model racer main body. Leg units 89 are provided at the left and right sides of the model racer main body 88. Each leg unit 89 includes two link members 90*a*, 90*b* which are connected with each other via a pin. The link members 90*a*, 90*b* are also connected with the model racer main body 88, the crank pulley 85 and the crank pedal 87 via pins. Accordingly, the leg units 89 move as the crank pulley 85 rotates. In other words, the model racer moves as if a real bicycle racer were riding a bicycle.

Indicated at 91 is an upper body unit of the model racer. The front end (right end in FIG. 9) of the model racer is secured on a handle unit 92 provided at the front end of the main frame 81.

Indicated at 93 are a pair of support rollers rotatably mounted on the lower portion of the main frame 81. The lower ends of the support rollers 93 are set lower than a line connecting the lower ends of the front and rear wheels 82 and 83. Thus, when the model bicycle 80 is placed on the running plate 22, it is supported by the rear wheel 83 and the pair of support rollers 93, and the front wheel 82 is supported slightly above the running plate 22.

Indicated at 94 is a permanent magnet mounted on the lower portion of the main frame 81. The lower end of the permanent magnet 94 is set slightly higher than the lower ends of the rear wheel 83 and the support rollers 93. Accordingly, when the model bicycle 80 is placed on the upper surface of the running plate 22, the permanent magnet is located above and spaced apart from the upper surface of the running plate 22 by a very small distance.

The running body 30, intermediate vehicle 60 and model bicycle 80 described above are disposed such that the permanent magnets 44, 63 and the permanent magnets 76, 94 face each other with the intermediate support plate 21 and the running plate 22 therebetween, respectively. Accordingly, the running body 30, the intermediate vehicle 60 and model bicycle 80 are pulled toward each other by the attraction of the permanent magnets 44, 63, 76 and 94. Thus, as the running body 30 runs, the intermediate vehicle 60 runs on the intermediate support plate 21 and the model bicycle 80 runs on the running plate 22.

Referring back to FIG. 2, indicated at 10 is the CCD camera as an area sensor, by 1 1 the transmission LED as a transmission means, and by 12 the game machine main body. The main body 12 is provided with a controller 13, a position detector 14 disposed between the CCD camera 10 and the controller 13, and a LED driver 15 disposed between the controller 13 and the transmission LED 11.

The controller 13 centrally controls an entire operation of the game machine according to this embodiment. The controller 13 includes a built-in computer (microcomputer), a ROM in which a game program and other programs are stored in advance, and a RAM for temporarily storing a position detection data from the position detector 14 and data being processed and storing necessary parameters.

In the case that there is provided one CCD camera 10, it is disposed substantially in the middle of the base 1 and at a specified height below the support plate 20 such that its sensing surface faces upward and the substantially entire lower surface of the base 1 falls within its view frame. Accordingly, the support plate 20 is a plate member of glass or like transparent material. The running body 30 is sensed by the CCD camera 10 through the support plate 20. In consideration of the view frame of the CCD camera 10, the support plate 20 preferably has a square or circular shape. However, in this embodiment, the shape of the support plate 20 conforms to the shape of the track 2.

As already known, the CCD camera 10 is such that a plethora of photodetectors which are solid-state photoelectric conversion elements are arranged in a matrix. For example, if the scanning cycle of the CCD camera 10 is selectable between 1/60 sec. per field and 1/30 sec. per frame, an image is picked up using 1 field as a scanning cycle. The CCD camera 10 outputs an electrical (image) signal having a converted level corresponding to an amount of rays received by the respective photodetectors.

An infrared transmission filter is disposed on a light receiving surface of the CCD camera 10 adopted in this embodiment so that the CCD camera receives only the infrared rays within a specified frequency band. In this way, an erroneous operation caused by external light is prevented. In place of the single CCD camera 10, a plurality of CCD cameras may be used. In such a case, the lower surface of the support plate 20 is divided into a plurality of areas, and images of the respective areas are picked up by the respective CCD cameras. With this arrangement, an image resolving power, i.e. a position detection accuracy can be improved.

The position detector 14 includes a frame memory in which the image signal from the CCD camera 10 is written, and an image processor for reading the content of the frame memory, detecting the position of the running body 30, and outputting coordinates representative of the detected position in the form of a detection signal. In this embodiment, the detection is performed in real time, more accurately, repeatedly at intervals of a very short period. Accordingly, in order to perform the image signal writing operation and the image signal reading operation in a parallel manner, there are provided two frame memories each having a storage capacity of 1 frame. The write only frame memory and the read only frame memory are switched in accordance with a switch signal from the image processor.

A technique for detecting the position of the running body 30 which is adopted by the image processor may be suitably selected from known image processing techniques. Since two LEDs 48, 49 are loaded in the running body 30 in this embodiment, an exemplary technique may be such that a suitable threshold value is set for the signal level of the image signal to convert the image into a binary data, and the position of a luminescent spot in the image is detected by means of pattern matching, labeling or the like.

The transmission LED 11 is a light emitting element for emitting, e.g. infrared rays. Similar to the CCD camera 10, the transmission LED 11 is disposed at a specified height below the support plate 20 such that it emits light upward. An infrared signal from the transmission LED 11 is transmitted toward the running body 30 running on the support plate 20 over a specified angle. A single transmission LED may be disposed in the center portion but, in order to more securely transmit the signal, it is better to provide a plurality of transmission LEDs so as to cover the respective divided areas of the support plate 20.

The transmission LEDs 1 1 are connected with the LED driver 15 which controllably drives the transmission LEDs 11 in accordance with a turn-on command signal from the controller 13 so that the transmission LEDs 11 transmit specified infrared pulse signals. The turn-on command signal is used to turn on the respective transmission LEDs 11. In the game machine in which a plurality of transmission LEDs 11 are provided, the LED driver 15 controllably drives the transmission LEDs 11 such that the transmission LEDs 11 connected in parallel with one another transmit synchronized optical pulse signals. Thus, even if the areas covered by the transmission LEDs 11 partly overlap, no interference occurs, thereby preventing an erroneous operation.

Next, the operation of the bicycle race game machine according to this embodiment is described.

Upon application of power to the game machine, the entire system is first initialized to reset values of a variety of variables. Further, a communication port of the controller 13 is initialized.

Subsequently, the controller 13 performs a processing to start one race. Specifically, a game start screen and an odds display screen are displayed on the monitor 4 of each operation unit 3. At this stage, it is waited on stand-by until the respective players make bets by means of the operation units 5, and then the respective model bicycles 80 are moved to a start line drawn in a specified position of the track 2. Further, the position detection by the position detector 14 is started to detect initial positions of the model bicycles 80 located along the start line (precisely speaking, the initial positions of the running bodies 30).

A race start processing includes determination of a scenario of this race, i.e. at which speeds the respective model bicycles 80 run and in which order the respective model bicycles 80 finish the goal (hereafter, race development). If the race development is same for every race, then the players lose their interest in the bicycle game. Accordingly, a plurality of race developments are stored in the ROM of the controller 13, and any one of these developments is selected every time the race start processing is performed.

Particularly, in the game machine according to this embodiment, the running body 30 for driving the model bicycle 80 runs along any desired course on the support plate 20 in accordance with a run control signal from the controller 13. Accordingly, the race development data includes a course data concerning as to which course each running body 30 runs (i.e. which course on the track 2 each model bicycle 80 runs). If the respective model bicycles 80 runs the same nonoverlapping courses every time, the course data may be provided separately from the race development data. Alternatively, if there is no predetermined race development and a run control for each model bicycle 80 is executed at specified intervals based on the position of the model bicycle 80, an operation of determining the race development can be omitted.

Thereafter, based on the determined race development and the detected initial positions of the respective model bicycles 80, target positions of the respective model bicycles 80 immediately after the start of the race is determined by the controller 13. For example, the target position is a position each model bicycle 80 reaches 1 sec. after the start.

Upon determination of the target positions, differences between the initial positions of the respective model bicycles 80 and the target positions thereof are calculated, and command values are output to the respective running bodies 30 in accordance with the calculated differences. The command values are converted by the infrared LED driver 15 into signals used to drive the transmission LED 11. Thus, the infrared optical pulse signals corresponding to the command values are transmitted from the transmission LED 11 to the respective running bodies 30.

The speed and direction of each running body 30 are instructed in accordance with only a target speed data. More specifically, the speed instruction is given to the wheels on one specific side, e.g. to the motors **46*a*, 46*b* for driving the drive wheels 33*a*, 33*b*, and the direction instruction is given in the form of a speed difference with respect to a rotating speed of the motor 46*a* (or motor 46*b*) on the specific side. The direction of the running body 30 may be similarly controlled by independently instructing the rotating speed to the respective motors 46*a*, 46*b***.

When the infrared ray receiving unit 51 of the running body 30 receives the infrared optical pulse signal from the transmission LED 11, the microcomputer 47 analyzes this signal; calculates the command value; and sends a signal to the motors **46*a*, 46*b* so as to drive the motors 46*a*, 46*b* at specified rotating speeds corresponding to the command signal. The motors 46*a*, 46*b* rotate in accordance with the signal from the microcomputer 47 while being supplied with a voltage from the power source via the current collecting electrode members 45, and thereby the drive wheels 33*a*, 33*b* rotates at specified rotating speeds. As a result, the running body 30** starts running in a specified direction at a specified speed corresponding to the command value.

As the running body 30 runs, the intermediate vehicle 60 and the model bicycle 80 start running in the same direction and at the same speed as the running body 30 due to the magnetic attraction of the permanent magnets 44, 63 and due to magnetic attraction of the permanent magnets 76, 94, respectively.

When the respective model bicycles 80 start running, thereby starting the race, the controller 50 receives data representative of current positions of the respective running bodies 30 which are detected by the position detector 14 at specified intervals (e.g. every several tens of msec.), and confirms the current positions of the running bodies 30. When the running bodies 30 reach the target positions, next target positions are calculated. A command value is calculated in accordance with the target position, and an infrared optical pulse signal is transmitted to the running bodies 30 via the infrared LED driver 15 and the transmission LED 11.

Upon receipt of the command value represented by the infrared pulse signal from the transmission LED 11, the microcomputer 47 of the running body 30 drives the motors 46*a*, 46*b* at the specified rotating speed in accordance with the command value as described above. As a result, the running body 30 (or the model bicycle 80) runs at the specified speed in the specified direction. The running of each running body 80 is controlled in accordance with the race development determined by repeating the above operation, and the race is performed.

During the race, the rollers 72 and the casters 74, 75 of the intermediate vehicle 60 constantly roll along the lower surface of the running plate 22 independently of the distance change between the intermediate support plate 21 and the running plate 22. Accordingly, the permanent magnet 76 provided in the upper portion of the intermediate vehicle 60 is also constantly spaced part from the lower surface of the running plate 22 by the very small distance. Thus, regardless of in which position of the track 2 the model bicycle 80 is, the model bicycle 80 is magnetically connected with the intermediate vehicle 60 due to the magnetic attraction, and runs as the intermediate vehicle 60 runs.

The game ends after all the model bicycles 80 run the track 2 around a predetermined number of times and finish the goal line drawn on the track 2. Upon completion of the game, the controller 13 stops sending the command values. Thereafter, the post-game processing is performed. Specifically, the running bodies which won the prizes are determined and displayed, and coins are paid to the player(s) who made a successful bet.

The race is performed as described above. In the game machine according to this embodiment, since the plurality of supply electrodes (positive supply electrode members 21*e* and negative supply electrode members 21*f*) are formed only on the bottom surface of the intermediate support plate 21 for supplying power, the arrangement of electrodes is very simple compared to the conventional arrangement of electrodes. This will reduce the time and costs for provision of electrodes and also increase the reliability in the aspect of power supply.

Particularly, the positive and negative supply electrodes are made of separate square members 21*e* and 21*f*. Accordingly, there is no likelihood that a current collecting electrode member 45 of one running body 30 and a current collecting electrode member 45 of another running body 30 come into contact with the same supply electrode 21*e* (21*f*).

Also, the positive and negative supply electrode members 21*e* and 21*f* are electrically connected to the single positive conductive plate 21*b* and the single negative conductive plate 21*c*. This will eliminate the problem in the conventional power supply arrangement that a plurality of running bodies simultaneously come into contact with the same supply electrode and cause an undesirable reduction in the power supply.

Further, the top surface of the intermediate support plate, i.e., the opposite surface to the surface on which the supply electrode members 21*e* and 21*f* are provided, is shielded by the third insulating layer 21*g* in this embodiment. Accordingly, compared to the problem in the Japanese Unexamined Utility Model Publication No. 1-56287 that electrodes are exposed, a longer durability can be assured for supply electrodes. Also, this will provide an improved safety for maintenance of power supply.

The present invention is not limited to the foregoing embodiment, but may be modified in various manners. For example, in the foregoing embodiment, the supply electrode members 21*e* and 21*f* have a square shape. However, the shape of a supply electrode member is not limited to the above, but the shape of a polygon such as triangle and hexagon or a round can be applicable. In addition, positive and negative supply electrode members are not necessarily formed into a shape identical to each other. For example, it may be appreciated that a number of positive supply electrode members are disposed at a specified interval and a common single negative electrode member is arranged in spaces between the positive supply electrode members.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A power supply device for a moveable object comprising:

a power supply member which is in the form of a plate and connected with a power source; the power supply member including:

a first conductive plate electrically connected with one of positive and negative terminals of the power source;

a second conductive plate electrically connected with the other terminal of the power source;

a first insulating layer provided between the first conductive plate and the second conductive plate;

a second insulating layer provided on the other surface of the second conductive plate that does not face the first insulating layer;

a plurality of supply electrode members attached on an outside surface of the second insulating layer, the plurality of supply electrode members being spaced from one another, said first insulating layer, said second conductive plate and said second insulating layer having aligned openings, first conductors passing through said aligned openings and electrically connecting said first conductive plate to one of said supply electrode members, said first conductors not being electrically connected to said second conducting plate, said second insulating member having passages, second conductors passing through said passages and electrically connecting said second conductive plate to another one of said supply electrode members;

a plurality of current collecting electrode members provided on a movable object which is movable on a planar surface, one of said current collecting electrode members being operable to come into contact with said one of said supply electrode members connected with the first conductive plate, and another one of said current collecting electrode members being operable to come into contact with said another one of said supply electrode members connected with the second conductive plate.

2. A power supply device according to claim 1, wherein:

the plurality of supply electrode members have the same polygonal shape as one another.

3. A power supply device according to claim 1, wherein:

the second conductive plate is electrically connected with the positive terminal of the power source.

4. A power supply device according to claim 1, further comprising a third insulating layer provided on the other surface of the first conductive plate that does not face the first insulating layer.

5. A power supply device according to claim 1 wherein said power supply plate overlies said moveable object and said current collecting electrode members.

6. A power supply device according to claim 1 further comprising a third insulating layer on the outer surface of the first conductive plate that does not face the first insulating layer, said third insulating layer overlying said first conductive plate, said first insulating layer overlying said second conductive plate, and said second insulating layer overlying said supply electrode members.

7. A power supply device according to claim 1 further comprising a third insulating layer on the outer surface of the first conductive plate that does not face the first insulating layer, a second moveable object overlying said power supply plate, said second moveable object being moveably supported on said third insulating layer.

8. A power supply device according to claim 7 wherein said second moveable object includes rollers which roll on said third insulating layer.

9. A power supply device according to claim 7 wherein said second moveable object moves on said third insulating layer in synchronism with the first said moveable object as said current collecting electrodes of the first said moveable object contact said supply electrode members.

10. A power supply device for a moveable object comprising:

a power supply member which is in the form of a plate and connected with a power source; the power supply member including:

a first conductive plate electrically connected with one of positive and negative terminals of the power source;

a second conductive plate underlying said first conductive plate and electrically connected with the other terminal of the power source;

a first insulating layer provided between the first conductive plate and the second conductive plate;

a second insulating layer provided on the other surface of the second conductive plate that does not face the first insulating layer;

a third insulating layer on the other surface of the first conductive plate that does not face the first insulating layer;

a plurality of supply electrode members attached on an outside surface of the second insulating layer, the plurality of supply electrode members being spaced from one another, one of said supply electrode members being electrically connected with the first conductive plate, another one of said supply electrode members adjacent to said one supply; second conductive plate;

a plurality of current collecting electrode members underlying said plurality of supply electrode members, said plurality of current collecting electrode members being provided on a movable object which is movable on a planar surface which underlies said power supply plate, one of said current collecting electrode members being operable to come into contact with said one of said supply electrode members connected with the first conductive plate, and another one of said current collecting electrode members being operable to come into contact with said another one of said supply electrode members connected with the second conductive plate.

11. A power supply device according to claim 10 wherein said first insulating layer, said second conductive plate and said second insulating layer having aligned openings, first conductors passing through said aligned openings and electrically connecting said first conductive plate to one of said supply electrode members, said first conductors not being electrically connected to said second conductive plate, said second insulating member having passages, second conductors passing through said passages and electrically connecting said second conductive plate to another one of said supply electrode members.

12. A power supply device according to claim 10 further comprising a second moveable object overlying said power supply plate, said second moveable object being moveably supported on said third insulating layer.

13. A power supply device according to claim 12 wherein said second moveable object includes rollers which roll on said third insulating layer.

14. A power supply device according to claim 12 wherein said second moveable object moves on said third insulating layer in synchronism with the first said moveable object as said current collecting electrodes of the first said moveable object contact said supply electrode members.

* * * * *